United States Patent [19]

Wallman et al.

[11] Patent Number: 4,967,877

[45] Date of Patent: Nov. 6, 1990

[54] FOLDING SAWHORSE

[75] Inventors: Randolph J. Wallman, Winnipeg; Lindsay T. Oliver, St. Norbert; Harvey Oliver, Winnipeg, all of Canada

[73] Assignee: CFH Corporation, Minot, N. Dak.

[21] Appl. No.: 466,078

[22] Filed: Jan. 16, 1990

[51] Int. Cl.[5] ..... B27B 21/00; B25H 1/06

[52] U.S. Cl. ..... 182/155; 182/181; 182/225

[58] Field of Search ..... 182/155, 181–186, 182/224, 225

[56] References Cited

U.S. PATENT DOCUMENTS

| | | | |
|---|---|---|---|
| 1,476,855 | 12/1923 | Topp | 182/155 |
| 2,174,952 | 10/1939 | Spiking | 182/155 |
| 2,573,740 | 11/1951 | Spiking | 182/155 |
| 2,794,688 | 6/1957 | Scott | 182/155 |
| 3,139,950 | 7/1964 | Bormann . | |
| 3,233,701 | 2/1966 | Hentzi | 182/155 |
| 3,269,487 | 8/1966 | Larson | 182/155 |
| 3,286,788 | 11/1966 | Swanson | 182/155 |
| 3,951,233 | 4/1976 | Meyers . | |
| 4,152,834 | 5/1979 | Stansberry | 182/155 |
| 4,489,808 | 12/1984 | Voye . | |
| 4,605,099 | 8/1986 | Crum et al. . | |
| 4,804,064 | 2/1989 | Coultrup et al. . | |

*Primary Examiner*—Reinaldo P. Machado

*Attorney, Agent, or Firm*—Murray E. Thrift; Stanley G. Ade; Adrian D. Battison

[57] ABSTRACT

A sawhorse has a T-shaped beam with two brackets secured to the beam adjacent its opposite ends. Legs are pivotally mounted on the brackets to pivot between extended positions projecting downwardly and sloping outwardly to the side and to the end of the beam and retracted positions lying along the underside of the top plate of the beam. The brackets are U-shaped sheet metal brackets that have support flanges at the top ends of their arms. The base of the bracket and the support flanges are connected to the vertical web of the main beam, while the top plate of the beam is also fastened to the support flanges. Locking pins are carried by the brackets to lock the legs in their extended and retracted positions. The pins are preferably adjustable.

12 Claims, 3 Drawing Sheets

FOLDING SAWHORSE

FIELD OF THE INVENTION

The present invention relates to sawhorse brackets and sawhorses using the brackets.

BACKGROUND

The present invention relates to a sawhorse of the type comprising a T-shaped beam having a horizontal plate and a vertical web, two brackets secured to the beam adjacent opposite ends thereof, four legs and means pivotally mounting two legs on each of the brackets for movement of the legs between extended positions projecting downwardly from the rail and retracted positions alongside the web.

A sawhorse of this type is disclosed in Meyers U.S. Pat. No. 3,951,233. In the disclosed structure, the legs are mounted on wooden wedges at either side of the vertical web. To limit the pivotal movement of the legs in their extended positions, and to provide support for the top plate of the beam, the top ends of the legs are cut at a double angle to provide a bearing surface engaging under the top plate of the saw horse. The construction of such an arrangement requires considerable precision, which may be difficult to achieve in a cost effective way. In addition, as parts wear, the legs will loosen and the required precision will be lost.

In Meyers, the legs are retained in their extended positions by the weight on the beam of the sawhorse. Movement of the horse could cause the legs to move relative to the beam, causing instability and possibly even collapse of the sawhorse.

The present invention is concerned with improvements in a sawhorse of this type and with a novel bracket for carrying those improvements into effect.

SUMMARY

According to one aspect of the present invention there is provided a sawhorse comprising a T-shaped beam having a horizontal plate and a vertical web, two brackets secured to the beam adjacent opposite ends thereof, four legs and means pivotally mounting two legs on each of the brackets for movement of the legs between extended positions projecting downwardly from the beam and retracted positions lying alongside the web, characterized in that each bracket comprises a substantially U-shaped base with upwardly convergent sides and support flanges projecting from upper edges of the sides, the base having a bottom panel secured at the centre thereof to a bottom edge of the web, the support flanges being engaged with and secured to the plate, each bracket having leg stop flanges projecting outwardly from the sides, at an end of the bracket adjacent the end of the beam, for engaging the legs and supporting them in the extended positions, and locking means for locking the legs in the extended and retracted positions.

The brackets provide excellent support for the T-shaped beam and for the legs without the high precision fitting of the components. The legs are locked in both extended and retracted positions.

In preferred embodiments, the legs are offset from their pivotal mountings to the brackets, with the legs on each side of the sawhorse being offset in the same direction. This provides an improved nesting of the legs in the retracted condition.

According to another aspect of the present invention there is provided a sawhorse bracket comprising:

a substantially U-shaped base with outer and inner ends, the base having upwardly convergent sides, support flanges projecting from upper edges of the sides, leg stop flanges projecting outwardly from the sides, at the outer end of the base, and a slot extending into each of the sides from the inner end of the base; and locking means comprising two locking pins, pin mounting means mounting each pin for movement between a locking position projecting through a respective one of the slots and a release position withdrawn from the slot, within the base, and resilient means for biasing the locking pin into the locking position.

The brackets may be used in pairs to construct a sawhorse of considerable stability without resorting to the use of high precision and difficult to manufacture parts.

The legs are supported in their extended positions by the leg stop flanges. They are prevented from releasing from this position by the pins.

BRIEF DESCRIPTION OF THE DRAWINGS

In the accompanying drawings which illustrate an exemplary embodiment of the present invention.

DETAILED DESCRIPTION

Figure 1:
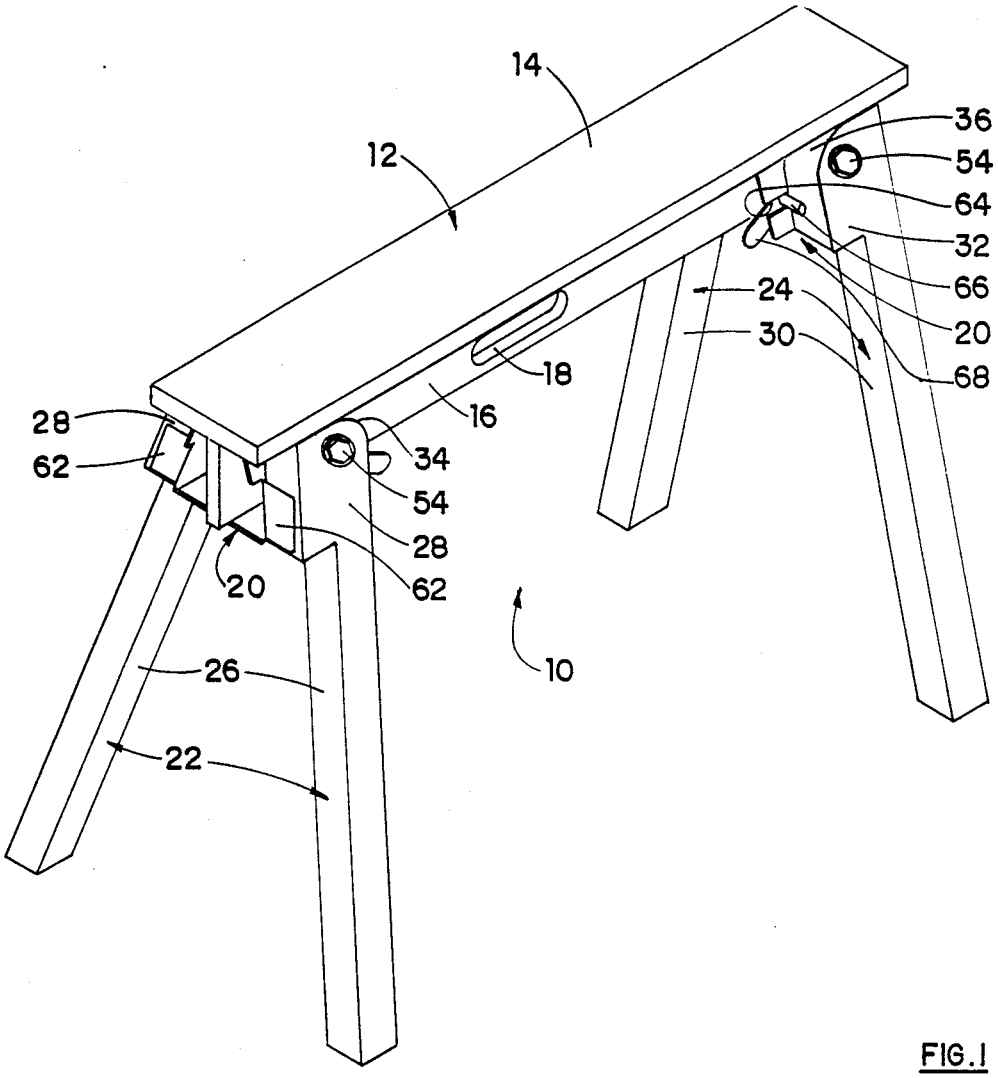
FIG. 1 is an isometric view of a sawhorse.

Referring to the accompanying drawings, and especially to FIG. 1, there is illustrated a sawhorse 10 with a T-shaped top beam 12. The beam includes a horizontal plate 14 and a vertical web 16 with its top edge morticed into the plate as shown most particularly in FIG. 4. An elongate hand hole 18 is formed through the web 16 so that the sawhorse can easily be carried in the inverted position when collapsed.

Figure 2:
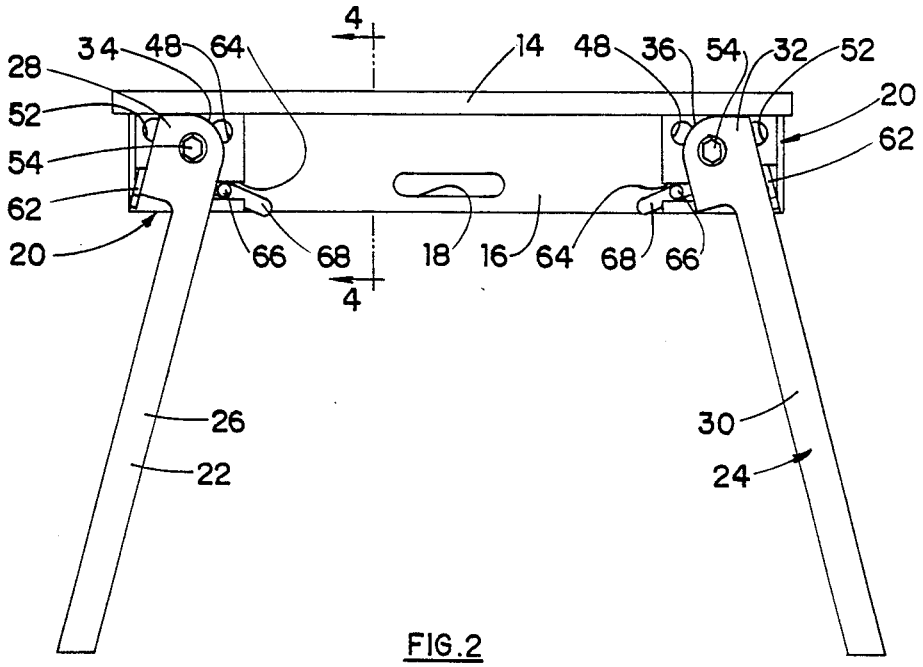
FIG. 2 is a side elevation of the sawhorse with the legs in the extended position.
Figure 3:
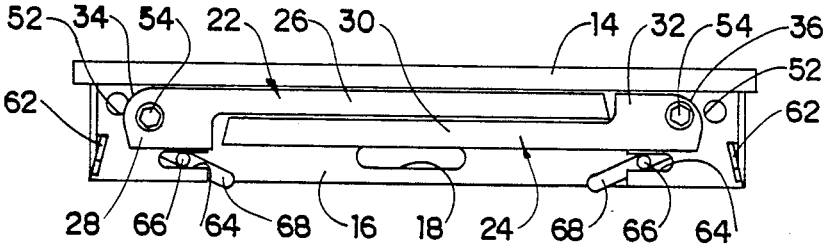
FIG. 3 is a side elevation of the sawhorse with the legs in the retracted position.
Figure 6:
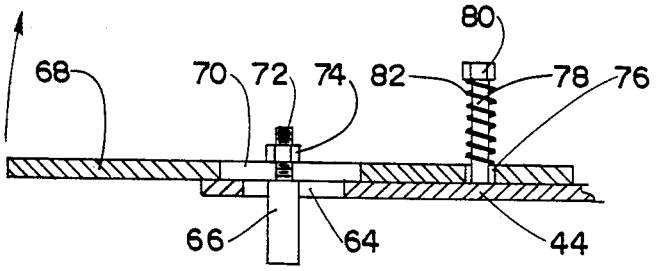
FIG. 6 is a view along line 6—6 of FIG. 5, and is found on the same sheet as FIGS. 2 and 3.

At either end of the beam 12 is a bracket 20. One of the brackets carries two legs 22 that extend down from the bracket and slope out both to the sides and to the ends of the beam. The other bracket carries two legs 24 that likewise slope out and to the end. Each of the legs 22 has a standard 26 and a head 28 that is offset from the standard towards the adjacent end of the beam 12. Each of the legs 24 has a standard 30 and a head 32 that is offset from the standard in a direction away from the adjacent end of the beam 12. As illustrated in FIGS. 1 and 2, the standards 26 and 30 on the same side of the beam 12 are offset with respect to their heads in the same direction. At the upper, inside corner of the leg 22, the leg is rounded at 34, while the upper, inside corner of each leg 24 is rounded at 36. As illustrated in FIG. 3, the legs 22 pivot upwardly from the extended position of FIG. 2 to the retracted position of FIG. 3, where the standard 26 lies on the underside of the plate 14. The leg 24 pivots upwardly in the opposite direction so that its standard 30 lies on the underside of the standard 26. This provides a compact nesting of the legs under the plate 14.

Figure 4:
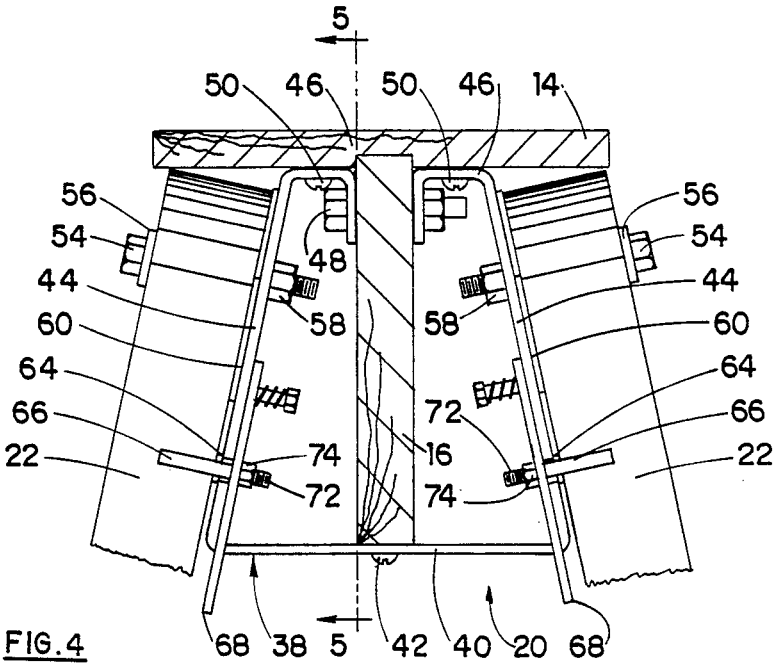
FIG. 4 is a partial elevation of the sawhorse along line 4—4 of FIG. 2.
Figure 5:
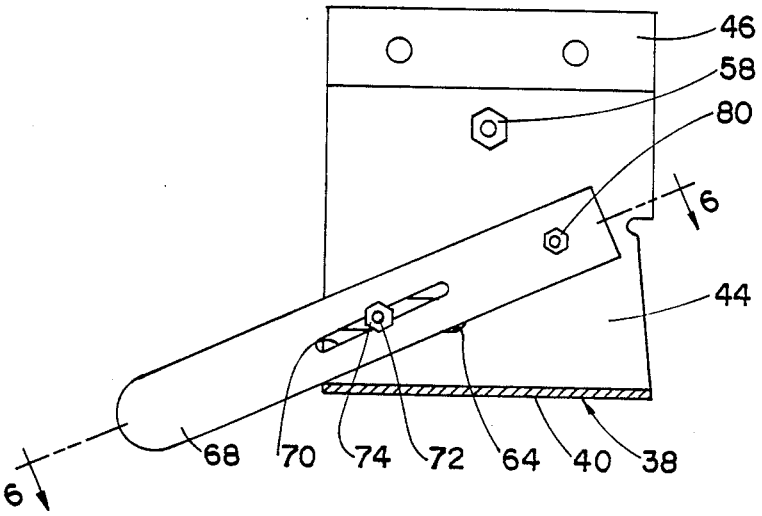
FIG. 5 is a view along line 5—5 of FIG. 4.

Each of the brackets 20 is made with a sheet metal base 38 of U-shape, as illustrated most particularly in FIG. 4. The base has a flat bottom panel 40 that is seated on the underside of the flange 14 and is secured to it by screws 42. The sides 44 of the base 38 are flat panels that slope upwardly and converge. Along the upper edge of each side is an inverted L-shaped support flange 46 that lies along the underside of the plate 14 and the side face of the flange 16. The support flange 46 is secured to the flange 16 of the beam 12 by two bolt and nut assemblies 48. It is secured to the underside of the plate 14 by screws 50. Bolt holes 52 (FIGS. 2 and 3) are formed in the sides 44 of the bracket base for access to the bolts 48.

Each of the legs is secured to one of the sides 44 of a bracket base with a bolt 54 extending through aligned holes in the leg and the side of the base. A washer 56 is fitted on the bolt under the head and a self-locking nut 58 is threaded onto the bolt on the interior of the bracket base. A large, nylon bearing washer 60 is fitted between the leg and the side 44 to prevent binding of the components.

At the outer end of the bracket base, are two leg support flanges 62. These project out from the sides 44 and slope inwardly towards the top. They abut the faces of the legs to limit their pivotal movement to the extended condition as illustrated in FIGS. 1 and 2. Each side 44 of the bracket base has a horizontal slot 64 extending into the side from the inner end of the bracket base. This accommodates a lock pin 66 that engages the face of the leg opposite the leg support flange t lock the leg in the extended or retracted condition as illustrated in FIGS. 2 and 3. The lock pin is carried by an arm 68. The arm has a slot 70 extending along the arm which receives a stud 72 on the end of the pin. A nut 74 on the stud serves to fix the lock pin 66 at a selected location along the slot 70. This provides for adjustment of the lock pin along the slot 64, to accommodate any manufacturing variations in the legs or to accommodate any leg wear that may have occurred.

The arm 68 is itself mounted on the interior of the associated side plate 44 with an aperture 76 fitted loosely onto a stud 78 on the side plate. A nut 80 is fitted onto the end of the stud 78 and a coil spring 82 is captured o the stud between the nut and the arm. This biases the arm against the interior face of the side plate 44. The loose fit of the aperture 76 on the stud 78 allows the arm to pivot inwardly to draw the lock pin 66 out of the slot 64, freeing the associated leg to pivot on its bolt 54.

While one embodiment of the invention has been described in the foregoing, it is to be understood that other embodiments are possible within the scope of the present invention. The invention is to be considered limited solely by the scope of the appended claims.

We claim:

1. A sawhorse bracket comprising:

a substantially U-shaped base with outer and inner ends, the base having upwardly convergent sides, support flanges projecting from upper edges of the sides, leg stop flanges projecting outwardly from the sides, at the outer end of the base, and a slot extending into each of the sides from the inner end of the base; and locking means comprising two locking pins, pin mounting means mounting each pin for movement between a locking position projecting through a respective one of the slots and a release position withdrawn from the slot, within the base, and resilient means for biasing the locking pin into the locking position.

2. A bracket according to claim 1 wherein the pin mounting means comprise pin adjustment means for adjusting the locking position of the pin along the slot.

3. A bracket according to claim 2 wherein each pin mounting means comprises an arm and means mounting the arm on a respective side of the base for pivotal movement towards and away from the side.

4. A bracket according to claim 3 wherein each pin adjustment means comprises a slot in a respective one of the arms, a stud projecting from an end of respective one of the locking pins through the slot in the associated arm, and a nut threaded onto the stud.

5. A bracket according to claim 3 wherein each pin mounting means further comprises a stud projecting from an internal face of a respective side of the base, an aperture in a respective one of the arms receiving the stud, the aperture being larger than the stud, and a nut on the stud, spaced from the associated side of the base.

6. A bracket according to claim 5 wherein the resilient means comprise a coil spring surrounding the stud and engaged between the arm and the nut.

7. A bracket according to claim 1 wherein the base comprises a substantially flat base panel and substantially flat side panels projecting upwardly therefrom.

8. A bracket according to claim 7 wherein the support flanges comprise inverted L-shaped flanges projecting towards on another from the upper edges of the sides of the base.

9. A sawhorse comprising a T-shaped beam having a horizontal plate and a vertical web, two brackets secured to the beam adjacent opposite ends thereof, four legs and means pivotally mounting two legs on each of the brackets for movement of the legs between extended positions projecting downwardly from the beam and retracted positions lying alongside the web, characterized in that each bracket comprises a substantially U-shaped base with upwardly convergent sides and support flanges projecting from upper edges of the sides, the base having a bottom panel secured at the centre thereof to a bottom edge of the web, the support flanges being engaged with and secured to the plate, each bracket having leg stop flanges projecting outwardly from the sides, at an end of the bracket adjacent the end of the beam, for engaging the legs and supporting them in the extended positions, and locking means for locking the legs in the extended and retracted positions.

10. A sawhorse according to claim 9 including an elongate hand hole in the web.

11. A sawhorse according to claim 9 wherein the legs slope outwardly to the sides and to the ends of the beam in the extended positions.

12. A sawhorse according to claim 11 wherein each leg comprises a standard portion and a head portion, the head portion being pivotally mounted on the associated bracket at a position offset from the standard portion, the legs on each side of the beam having the standards offset with respect to the respective pivots in the same direction along the beam.

* * * * *